United States Patent [19]

Freeman

[11] 4,122,746

[45] Oct. 31, 1978

[54] STRINGED MUSICAL INSTRUMENT PICK

[76] Inventor: Quilla H. Freeman, 1050 N. Gardner St., Los Angeles, Calif. 90046

[21] Appl. No.: 760,190

[22] Filed: Jan. 17, 1977

[51] Int. Cl.[2] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 3,648,558 | 3/1972 | Chenette | 84/322 |
| 3,699,838 | 10/1972 | Montgomery | 84/322 |
| 4,015,502 | 4/1977 | Strong | 84/322 |

*Primary Examiner*—Lawrence R. Franklin

[57] ABSTRACT

A thumb pick for stringed musical instruments comprised of a flat triangular shaped main body. A short hook projects outwardly at right angles from the lower portion of said main body. One end of a flexible band is anchored to a hole near the top of said main body; the other end of said flexible band is anchored to said hook and stretches over the thumb nail holding the pick in place with a positive non-slip grip.

4 Claims, 4 Drawing Figures

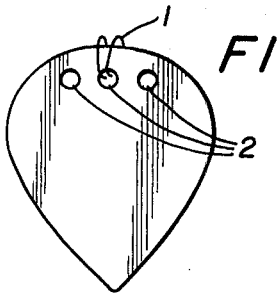
FIG. 1
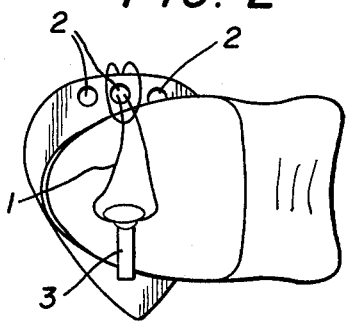
FIG. 2
FIG. 3
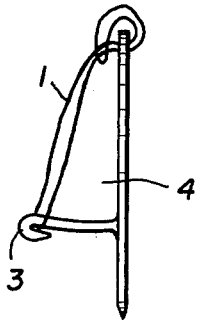
FIG. 4
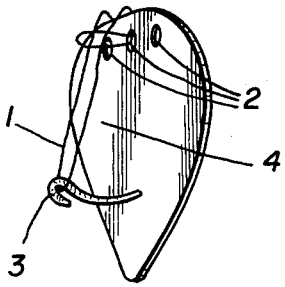

STRINGED MUSICAL INSTRUMENT PICK

BACKGROUND OF THE INVENTION

1. Field of Invention

An accessory for stringed musical instruments that require plucking of the strings with a pick.

2. Description of the Prior Art

The Chnette, U.S. Pat. No. 3,648,558 employs a rubber band that completely encircles the thumb above the first joint. Said rubber band serves as an anchor exerting a length-wise force pulling against two fastening elements which are bent over the end of the thumb. My invention's unique one-piece design holds the pick in place with a transverse force utilizing a simple rubber band stretched across the thumb nail. Said means substantially reduces the strangulation of the blood supply to the end of the thumb which results in a comfortable positive non-slip grip.

The Dopyera, U.S. Pat. No. 2,045,571 employs an oval main body of flexible type material that completely encircles the thumb. Size adjustments for large or small digits are provided by means of a set screw or spring device with very limited provisions for different shaped thumbs. The main body of my patent is flat and does not encircle the thumb the gripping means is provided by a rubber band that easily conforms to any shape or size of thumb.

The Montgomery, U.S. Pat No. 3,699,838 utilizes a loop that expands outward when the thumb is inserted between said loop and the main body. It can be observed that no means is provided to keep the pick from twisting and falling off when utilized as a thumb pick. My pick is flat and does not expand or deform in any way; the rubber provided stretches across the thumb nail holding the pick securely in place.

SUMMARY OF THE INVENTION

With this invention a pick is utilized which has a flat rigid triangular main body. A small hook protrudes outward at right angles from the lower portion of said main body. A hole is provided in the upper portion of said main body. One end of a flexible, e.g., rubber, band is looped through the hole; the other end of the rubber band is looped around the hook. When the thumb is inserted between the rubber band and the main body, the rubber band is expanded outward resulting in a constriction action pressing the triangular main body firmly against the front of the thumb which holds the pick securely in place. The rubber band stretches across the thumb nail greatly reducing the stoppage of blood to the end of the thumb. A further object of my invention is a thumb pick that will comfortably fit all sizes and shapes of thumbs including long, narrow, large, round, short, pointed, etc. or any combination of the above, and not fall off the thumb.

BRIEF DESCRIPTION OF DRAWING

FIG. 1. Plain view of the front of thumb pick.

FIG. 2. View from the back showing the thumb inserted between main body and rubber band.

FIG. 3. Transverse view of the thumb pick.

FIG. 4. Perspective of the thumb pick.

DESCRIPTION OF THE PREFERRED EMBODIMENT

Referring to FIG. 1, the thumb pick is preferably constructed with a flat, generally triangular body, preferably of an essentially rigid plastic material which will not excessively bend or deform, thus remaining flat when pressed firmly against the pad of the player's thumb. The non-beading property of the main body of the pick holds the thumb pick perpendicular to the plane of the strings, thereby greatly enhancing the ease of picking back and forth across the strings of the musical instrument. The body has three holes 2 therethrough, proximate the broad edge, the purpose of which is to provide a choice for attaching a flexible element, e.g., an endless rubber band 1. When rubber band 1 is attached to the center one of the holes 2, the thumb pick is held with its apex extending substantially at right angles to the thumb. Attachment of the rubber band 1 to either one of the side holes 2 will tilt the main body of the pick longitudinally, moving the apex portion of the triangular body outward or inward relative to the thumb tip, thus providing a choice of three positions to suit the taste of the player.

Referring to FIGS. 2, 3, and 4, showing the backside of the thumb pick body, a hook member 3 is secured to the pick body in the vicinity of the apex of the body and extending outwardly from the backside of the body as a means of connection to another portion of the rubber band 1. Preferably, the free outer extremity of the hook 3 terminates in a hook portion for anchoring the rubber band 1. As can be seen in FIG. 2, the rubber band 1 tightly stretches across the hard thumb nail of the user to protect the soft part of the thumb from the cutting force of the rubber band 1, thus enabling the player to play for long periods of time in comfort.

As is shown in FIG. 3, when the thumb of the user is removed, a generally triangular aperture 4 is defined between the plane of the body of the thumb pick and rubber band 1. Then, when the thumb is thrust through aperture 4, rubber band 2 is stretched outwardly from the plane of the body of the pick creating a constricting force around the thumb to hold the thumb pick in a firm, non-slip grip. As is best seen in FIG. 4, with this arrangement the pick is designed for ease of slipping on and off the thumb without adjustments of any kind, thereby shortening the time required for the pick player to be in ready position for performing. It should also be noted that the flexible band will conform to virtually any shape or size of thumb.

I desire to protect by Letters Patent claiming the following:

1. A thumb pick for picking the strings of a stringed musical instrument, comprising:
   - a flat, generally triangular body having an apex used for picking said strings and a relatively broad edge opposite said apex;
   - a flexible band attached to said body proximate said broad edge, said band having a loop formed at the end remote from said body;
   - a hook member connected to said body in the vicinity of said apex, said hook member extending outwardly from said body;
   - whereby said pick may be affixed to a player's thumb by stretching said band around said thumb and connecting said loop to said hook member.

2. A thumb pick as in claim 1 wherein said body has at least one hole therethrough proximate said broad edge and said flexible band is a rubber band looped through said hole.

3. A thumb pick as in claim 2 wherein said body has three holes therethrough parallel to and proximate to said broad edge, any one of which is adapted to receive said rubber band therethrough.

4. A thumb pick as in claim 1 wherein said hook member extends from said body at approximately a right angle and cooperating with said flexible band to form an expandable, triangular, right angled aperture for the insertion of said thumb.

* * * * *